United States Patent [19]

Fröhlich et al.

[11] Patent Number: 5,035,125

[45] Date of Patent: Jul. 30, 1991

[54] SLIDE-FASTENER STRINGER HALF WITH KNITTED-IN COUPLING COIL

[75] Inventors: Alfons Fröhlich, Essen, Fed. Rep. of Germany; Anton Probst, Frick, Switzerland

[73] Assignee: Opti-Patent-, Forschungs-und Fabrikations-AG, Riedern-Allmeind, Switzerland

[21] Appl. No.: 481,363

[22] Filed: Feb. 16, 1990

[30] Foreign Application Priority Data

Feb. 25, 1989 [DE] Fed. Rep. of Germany ..... 3905933
Feb. 25, 1989 [DE] Fed. Rep. of Germany ..... 3905934
Feb. 25, 1989 [DE] Fed. Rep. of Germany ..... 3905935

[51] Int. Cl.[5] ..... D04B 23/08
[52] U.S. Cl. ..... 66/193; 66/86 R
[58] Field of Search ..... 66/192, 193

[56] References Cited

U.S. PATENT DOCUMENTS 3,840,946 10/1974 Fröhlich et al. ..... 66/193 X
3,864,945 2/1976 Fröhlich ..... 66/193
4,041,577 8/1977 Matsuda ..... 66/192
4,075,874 2/1977 Heimberger ..... 66/192
4,098,299 7/1978 Fröhlich .
4,134,185 1/1979 Heimberger ..... 66/193 X

FOREIGN PATENT DOCUMENTS 2614932 10/1977 Fed. Rep. of Germany ..... 66/192
2540272 1/1980 Fed. Rep. of Germany .
2622529 6/1980 Fed. Rep. of Germany .
346297 4/1931 United Kingdom ..... 66/192
8800627 1/1988 PCT Int'l Appl. ..... 66/192

OTHER PUBLICATIONS

Application of Weft Insertion Principles to Warp Knitting, K. D. Darlington—The Hosiery Trade Journal, vol. 77, #915, 3-1971.

*Primary Examiner*—Werner H. Schroeder
*Assistant Examiner*—John J. Calvert
*Attorney, Agent, or Firm*—Herbert Dubno; Andrew Wilford

[57] ABSTRACT

A slide-fastener stringer half has a coupling coil having a row of turns defining a longitudinal passage and each formed with a coupling head, an upper leg and a lower leg extending transversely from the head and flanking the passage, and a bight extending from one of the respective legs to the other leg of the adjacent turn. A knitted tape against which the lower legs engage and from a longitudinal edge of which the heads project is formed of a plurality of outer warp chains adjacent the coil, an upper warp chain overlying both the upper and lower legs of the coils, and a lower warp chain overlying only the lower legs of the coil and extending along the passage between the upper and lower legs of the coil. Thus with this system the group of filaments forming the lower warp chain takes the place of the normally provided filling cord.

9 Claims, 2 Drawing Sheets

SLIDE-FASTENER STRINGER HALF WITH KNITTED-IN COUPLING COIL

FIELD OF THE INVENTION

The present invention relates to a slide fastener. More particularly this invention concerns a slide-fastener stringer half with a knitted-in synthetic-resin coupling coil.

BACKGROUND OF THE INVENTION

A standard slide fastener comprises a pair of symmetrically identical stringer halves each comprising a textile tape to whose edge is fixed a coupling coil. The coil is formed of a row of turns each in turn forming a coupling head that projects from a longitudinal edge of the respective tape toward the other tape and can be interleaved between the heads of the other tape to join the two tapes together. Each turn of the coupling coil comprises, in addition to the already mentioned head, a lower leg lying on the tape, an upper leg offset from the plane of the tape, and a bight joining one of the legs of the turn to the other leg of the adjacent turn, with both legs and the head of each turn normally lying on a common plane perpendicular to the coil. The coil can be secured to the tape by actually having floats or filaments of the tape engaged over the legs so that in effect each coil is knitted into the respective tape.

In U.S. Pat. No. 4,075,874 such a stringer half is described where the coiling coil is secured exclusively by warp chains engaged over the upper legs of the coil. The preformed coil is fed like a weft filament into the tape as the same is knitted. Such a stringer half is easily damaged when kinked or creased and is particularly susceptible to damage when subjected to a transverse stress which can shift the coil in the knitted tape.

OBJECTS OF THE INVENTION

It is therefore an object of the present invention to provide an improved slide-fastener stringer half with a knitted-in coupling coil.

Another object is the provision of such an improved slide-fastener stringer half with a knitted-in coupling coil which overcomes the above-given disadvantages, that is which is simple to manufacture but very robust and resistant to damage in use.

SUMMARY OF THE INVENTION

A slide fastener stringer half according to this invention comprises a coupling coil having a row of turns defining a longitudinal passage and each formed with a coupling head, an upper leg and a lower leg extending transversely from the head and flanking the passage, and a bight extending from one of the respective legs to the other leg of the adjacent turn. A knitted tape against which the lower legs engage and form a longitudinal edge of which the heads project is formed of a plurality of outer warp chains adjacent the coil, an upper warp chain overlying both the upper and lower legs of the coils, and a lower warp chain overlying only the lower legs of the coil and extending along the passage between the upper and lower legs of the coil. Thus with this system the group of filaments forming the lower warp chain takes place of the normally provided filling cord.

As compared with the float chains engaging over the top legs of the coupling members, the additional wale in accordance with the invention forms a relatively small float loop, that is, a yarn bridge which is very small in comparison with the loops of the warp chains and which engages over the bottom legs of the coupling coil to provide very reliable retention. This provides a surprising improvement in buckling strength and transverse tensile strength. For the rest, as a result of the features described, the rows of coupling members are secured more tightly to the support tapes than in the known construction.

According to a preferred embodiment transverse displacement of the rows of coupling members relatively to the support tapes can be completely obviated, even in the event of extremely high transverse tensile forces, by providing the lower chain between the upper chain and the tape chains, that is closer to the coil bights than to the coil heads. Alternatively, the connecting parts may be disposed near the center of the legs of the coupling members.

In the preparation of a slide fastener according to the invention the coupling member rows need not of course be supplied prefabricated to an automatic knitting machine. Indeed, the coupling members and, therefore, the rows thereof are produced as the support tapes are knitted. This causes no difficulties if the plastics monofilaments are laid in as a weft filament and two coupled-together rows of coupling members are wound in opposite directions around the end of a freely pivotal mandrel in the manner known for the weaving of slide fasteners, for example, from U.S. Pat. No. 4,098,299. The plastics monofilaments can be connected during the knitting of the support tapes to the bottom-leg wales. In the formation of the coupling members the plastics monofilaments experiences a 90° twist which is of use more particularly for forming the coupling heads if the plastic monofilament used is of elliptical cross-section. The floating connection by way of the wales to the ground fabric of the support tapes can proceed on the basis of double-weft or single-weft operation, the latter being preferred. The coupling member rows with the support tapes are withdrawn coupled together from the mandrel, then thermoset and possibly given shrinkage treatment. Crochet galloon machines, Raschel machines or warp knitting machines can be used for this purpose. Preferably, crochet galloon machines are used.

In the slide-fastener stringer half according to this invention filaments of the upper and lower warp chains can engage over the turn legs. In addition a weft filament can extend mainly crosswise to and interconnect all of the warp chains. This gives the fastener eventually made, by addition of end-stop members and a slider, of two such stringer halves considerable resistance to rupture when the two stringer halves are pulled transversely apart.

More particularly according to this invention the outer and inner warp chains are formed of stitches each extending longitudinally over at least two courses. The stitches of the upper chain are staggered by one course relative to the stitches of the lower chain. Additional inlays, for instance like a tricot knot, are also possible.

Furthermore in accordance with this invention the tape warp chains are formed of stitches each extending longitudinally over at least two courses and every other tape warp chain is staggered by one course relative to the lower warp chain. In addition the outer and inner warp chains are formed of stitches and the stitches of the upper chain are staggered by a half a course relative to the stitches of the lower chain. Finally the chains are formed by respective filaments and the filament of the inner warp chain is substantially thicker than that of the outer warp chain.

It is further possible according to this invention to make the tape in a two-phase knitting process so that it comprises a first weft filament laid uniformly into all of the chains and a second weft filament laid in a pattern into only some of the chains. Such a tape has excellent resistance to kinking or damage.

DESCRIPTION OF THE DRAWING

The above and other objects, features, and advantages will become more readily apparent from the following, reference being made to the accompanying drawing in which.

SPECIFIC DESCRIPTION

Figure 1:
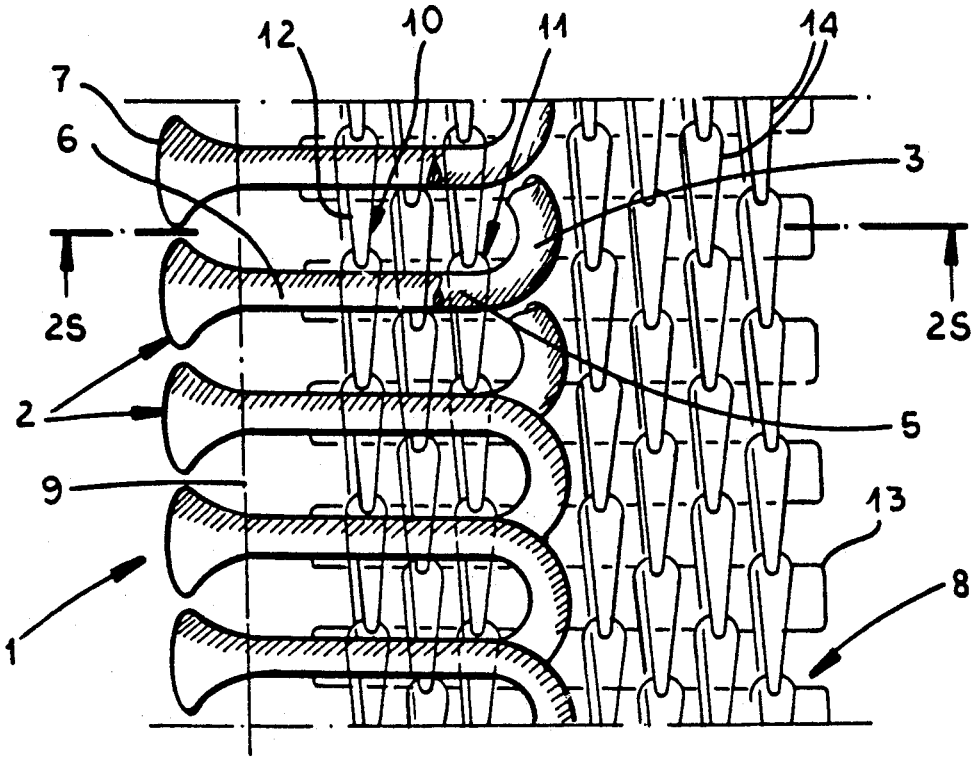
FIG. 1 is a large-scale and largely diagrammatic top view of a part of a slide-fastener stringer half according to this invention.
Figure 2:
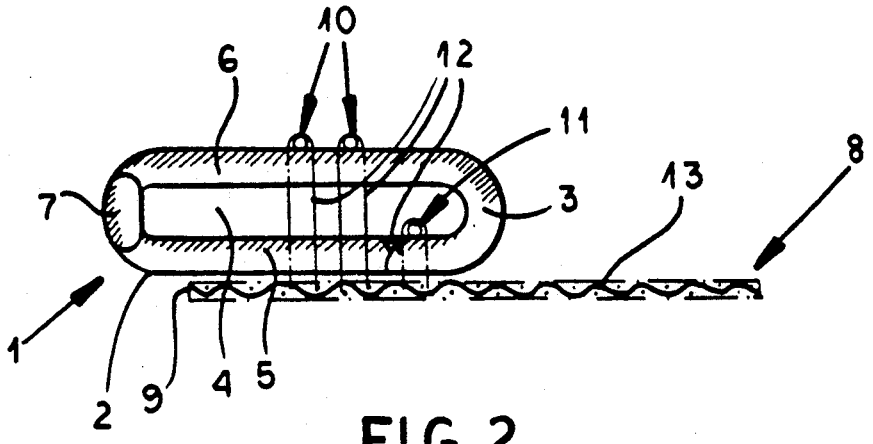
FIG. 2 is a section taken along line 2S—2S of FIG. 1.

As seen in FIGS. 1 and 2 a slide fastener stringer half has a helicoidal coil 1 made of a succession of identical turns 2 of a synthetic-resin monofilament. The turns 2 of the row 1 together form a longitudinal passage 4 and each have a connecting bight 3, a lower leg 5 lying on a support tape 8, and upper leg 6, and a coupling head 7. The connecting bights 3 each connect a top leg 6 of one turn 2 to a bottom leg 5 of an adjacent turn 2. The knitted support tape 8 supports the coil 1 with the coupling heads 7 projecting beyond the inside edge 9 of the support tape, which edge is shown in FIG. 1 as a dot-dash line. For the sake of clarity of view all the yarns of the knitted fabric are not shown in FIG. 1 and the yarns of the knitted fabric are represented merely as thin lines.

The turns 2 are connected to the support tapes 8 by means of inner warp chains 10 which engage over the top legs 6 of the turns 2 and also over the bottom legs 5 and which are knitted into the tapes 8. At least one additional separate bottom-leg inner warp chain 11 engages like a filling core around the bottom legs 5 of the turns 2, the separate warp chain 11 being knitted into the associated support tape 8 between the warp chains 10. The bottom-leg warp chain 11 is near the rear connecting bights 3 whereas the warp chains 10 engage over the top legs 6 near the coupling heads 7. Yarns 12 of the bottom-leg warp chains 11 and of the warp chains 10 engage over the bottom legs 5 and top legs 6, respectively, of the turns 2 of the coil 1. In practice, of course, the bottom-leg warp chain 11 shown in FIG. 1 merely in the form of dashes generally fills the passage 4 between the legs 5 and 6. As indicated, the bottom-leg warp chains 11 and the warp chains 10 are knitted into the support tape 8 which also is formed by weft yarns 13 which extend over the entire width of the tape including the region of the coil 1. These weft yarns 13 need not extend to where the tapes 8 do not have to take transverse tensile stresses. The bottom-leg warp chains 11 and the warp chains 10 in the tapes each extend over two courses, that is they jump over one weft row.

FIG. 2 shows how the warp chains 10 engage over the top legs 6 and how the bottom-leg warp chains 11 extend in the passage 4 and there form filling yarns and very small connecting loops. The chains 10 and 11 in effect act as a continuous textile filling core of the kind known per se in slide fasteners having helical rows of turns made of a plastic monofilament.

Adjacent warp chains 10 and bottom-leg warp chains 11 are staggered relative to one another by one course. This is also true in the portion of the tape 8 offset from the zone of the turns 2. In this case the stitches of every other warp chain in every course are staggered by a partial stitch relatively to the stitches of every first warp chain. This is effective in the embodiment irrespective of whether the warp chains concerned are upper warp chains 10, lower warp chains 11, or outer tape warp chains 14. The stitches of every other warp chain are staggered by half a stitch relatively to the stitches of the alternating warp chains. The bottom-leg warp chain 11 can be made from a thicker yarn than the upper warp chains 10 and tape warp chains 14.

Figure 3A:
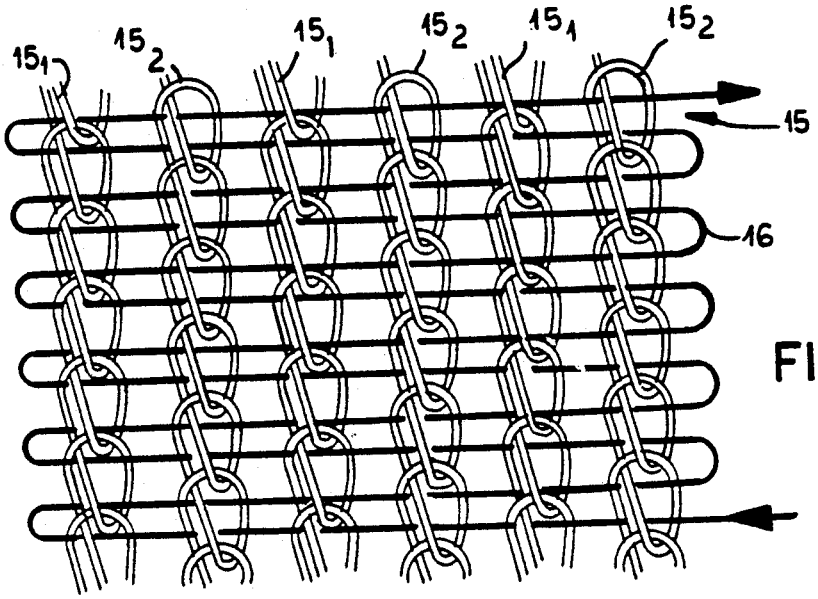
FIGS. 3*a*, 3*b*, and 3*c* are schematic illustrations of a tape made by a two-phase knitting technique according to this invention.
Figure 3B:
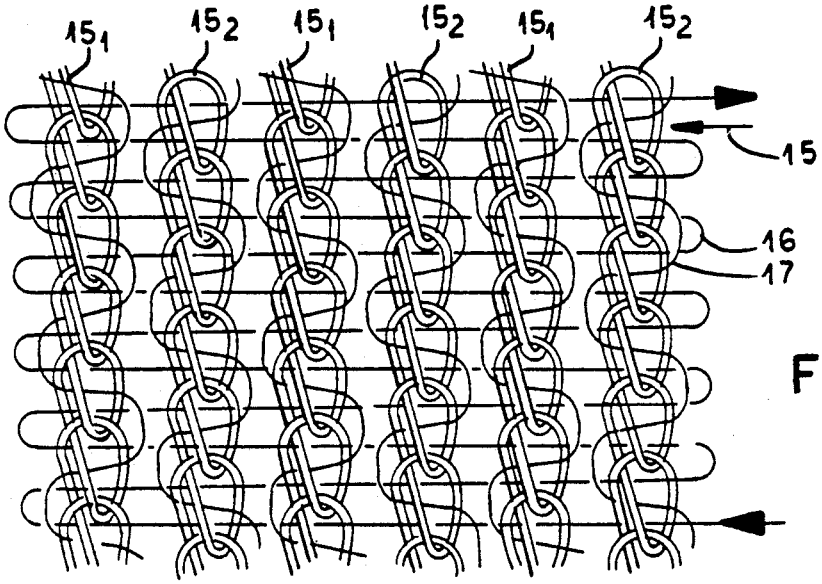
Figure 3C:
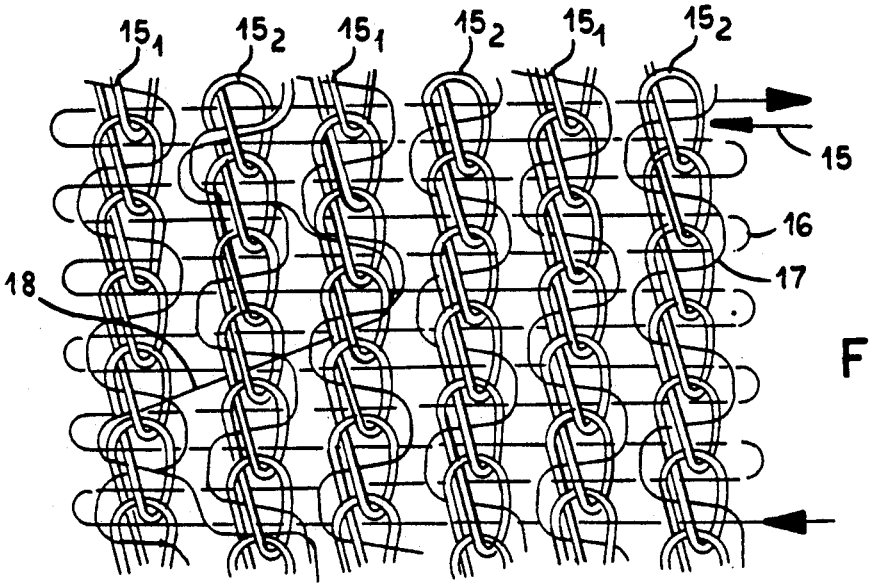

FIGS. 3*a* through 3*c* serve to show the basic principles of two-phase knitting according to the invention. The knitted structure is based on warp knits in which warp chains 15 of like direction are interconnected by laid-in weft yarns 16. In all cases, however, the stitches of every other warp chain 15 are staggered by a partial stitch relative to the stitches of every first warp chain 15. FIG. 3*a* shows part of a warp knit structure having complete weft yarns 16 only. FIG. 3*b* shows the warp knit structure of FIG. 3*a* but with partial weft yarns 17 also disposed in the warp chains 15. In FIG. 3*c* a further partial weft yarn 18 is threaded in accordance with a pattern. A comparison of FIGS. 3*a*, 3*b* and 3*c* with FIGS. 1 and 2 shows how this two-phase knitting is carried into effect in slide fasteners according to the invention.

The support tapes of the slide fasteners can also be made with the patterns shown in FIG. 3.

I claim:

1. A slide fastener stringer half comprising:

a coupling coil having a row of turns defining a longitudinal passage and each formed with a coupling head, an upper leg and a lower leg extending transversely from the head and flanking the passage, and a bight extending from one of the respective legs to the other leg of the adjustment turn; and a knitted tape against which the lower legs engage and from a longitudinal edge of which the heads project, the tape being formed of a plurality of outer warp chains adjacent the coil, an upper inner warp chain overlying both the upper and lower legs of the coils, and a lower inner warp chain overlying only the lower legs of the coil and extending along the passage between the upper and lower legs of the coil, the outer and inner warp chains being formed of stitches each extending longitudinally over at least two courses, the stitches of the upper chain being staggered by one course relative to the stitches of the lower chain.

2. The slide-fastener stringer half defined in claim 1 wherein the lower warp chain lies between the outer warp chains and the upper warp chain.

3. The slide-fastener stringer half defined in claim 1 wherein filaments of the upper and lower warp chains engage over the legs of the turns.

4. The slide-fastener stringer half defined in claim 1, further comprising:

a weft filament extending mainly crosswise to and interconnecting all of the warp chains.

5. The slide-fastener stringer half defined in claim 1 wherein the outer and inner warp chains are formed of stitches each extending longitudinally over at least two courses.

6. The slide-fastener stringer half defined in claim 1 wherein every other outer warp chain is staggered by one course relative to the lower warp chain.

7. The slide-fastener stringer half defined in claim 1 wherein the chains are formed by respective filaments and the filament of the lower warp chain is substantially thicker than that of the upper warp chain.

8. The slide fastener stringer half defined in claim 1, further comprising:

a first weft filament laid uniformly into all of the chains; and a second weft filament laid in a pattern into only some of the chains.

9. A slide-fastener stringer half comprising:

a coupling coil having a row of turns defining a longitudinal passage and each formed with a coupling head, an upper leg and a lower leg extending transversely from the head and flanking the passage, and a bight extending from one of the respective legs to the other leg of the adjacent turn; and a knitted tape against which the lower legs engage and from a longitudinal edge of which the heads project, the tape being formed of a plurality of outer warp chains adjacent the coil, an upper inner warp chain overlying both the upper and lower legs of the coils, and a lower inner warp chain overlying only the lower legs of the coil and extending along the passage between the upper and lower legs of the coil, the outer and inner warp chains being formed of stitches and the stitches of the upper chain being staggered by a half a course relative to the stitches of the lower chain.

* * * * *